US006180684B1

(12) United States Patent
Halmo et al.

(10) Patent No.: US 6,180,684 B1
(45) Date of Patent: Jan. 30, 2001

(54) PROCESS AND AN INTEGRATED PLANT FOR THE PRODUCTION OF SYNFUEL AND ELECTRICAL POWER

(75) Inventors: Terje M. Halmo, Stavanger; Alf S. Martinsen, Sandnes; Roger Hansen; Dag Schanke, both of Trondheim, all of (NO)

(73) Assignee: Den Norske Stats Oljeselskap A.S., Stavanger (NO)

( * ) Notice: Under 35 U.S.C. 154(b), the term of this patent shall be extended for 0 days.

(21) Appl. No.: 09/341,892

(22) PCT Filed: Jan. 23, 1998

(86) PCT No.: PCT/NO98/00023

§ 371 Date: Sep. 3, 1999

§ 102(e) Date: Sep. 3, 1999

(87) PCT Pub. No.: WO98/32817

PCT Pub. Date: Jul. 30, 1998

(30) Foreign Application Priority Data

Jan. 24, 1997 (NO) ..... 970323

(51) Int. Cl.[7] ..... C07C 27/00; F01K 25/00; F02C 3/14

(52) U.S. Cl. ..... 518/705; 518/703; 518/704; 518/700; 60/670; 60/39.35

(58) Field of Search ..... 518/703, 704, 518/705, 700; 60/670, 39.35

(56) References Cited

U.S. PATENT DOCUMENTS

| | | | | |
|---|---|---|---|---|
| 4,594,140 | | 6/1986 | Cheng | 208/414 |
| 4,927,856 | | 5/1990 | Elion | 518/702 |
| 5,177,114 | | 1/1993 | van Dijk et al. | 518/703 |
| 5,472,986 | | 12/1995 | van Dijk | 518/705 |
| 5,635,541 | * | 6/1997 | Smith et al. | 518/703 |

FOREIGN PATENT DOCUMENTS

| | | | |
|---|---|---|---|
| 179169 | 10/1992 | (NO) | C07C/27/07 |

OTHER PUBLICATIONS

International Search Report; PCT/NO98/00023; Jul. 7, 1998; Jack Hedlund.

"Industriell . . . naturgass"; Jan M. Overli; Institutt for termisk energi og vannkraft at NTNU; 64168 Gassteknologi, chapter 6; see in particular p. 7.

WO 91/15446, corresponding to PCT/US91/02354, published Oct. 17, 1991.

* cited by examiner

*Primary Examiner*—Johann Richter
*Assistant Examiner*—J. Parsa
(74) *Attorney, Agent, or Firm*—Fish & Richardson P.C.

(57) ABSTRACT

The present invention relates to a process and an integrated plant to be used in the process for the preparation of synthetic fuel (synfuel) and production of electrical energy. A part of the energy produced is used for the operation of the energy requiring steps of the process, whereas the residual part is exported for other purposes. The warm exhaust gas from the part of the plant producing electrical energy is fed to a preheating step for natural gas being used as a starting material for the preparation of synfuel.

34 Claims, 1 Drawing Sheet

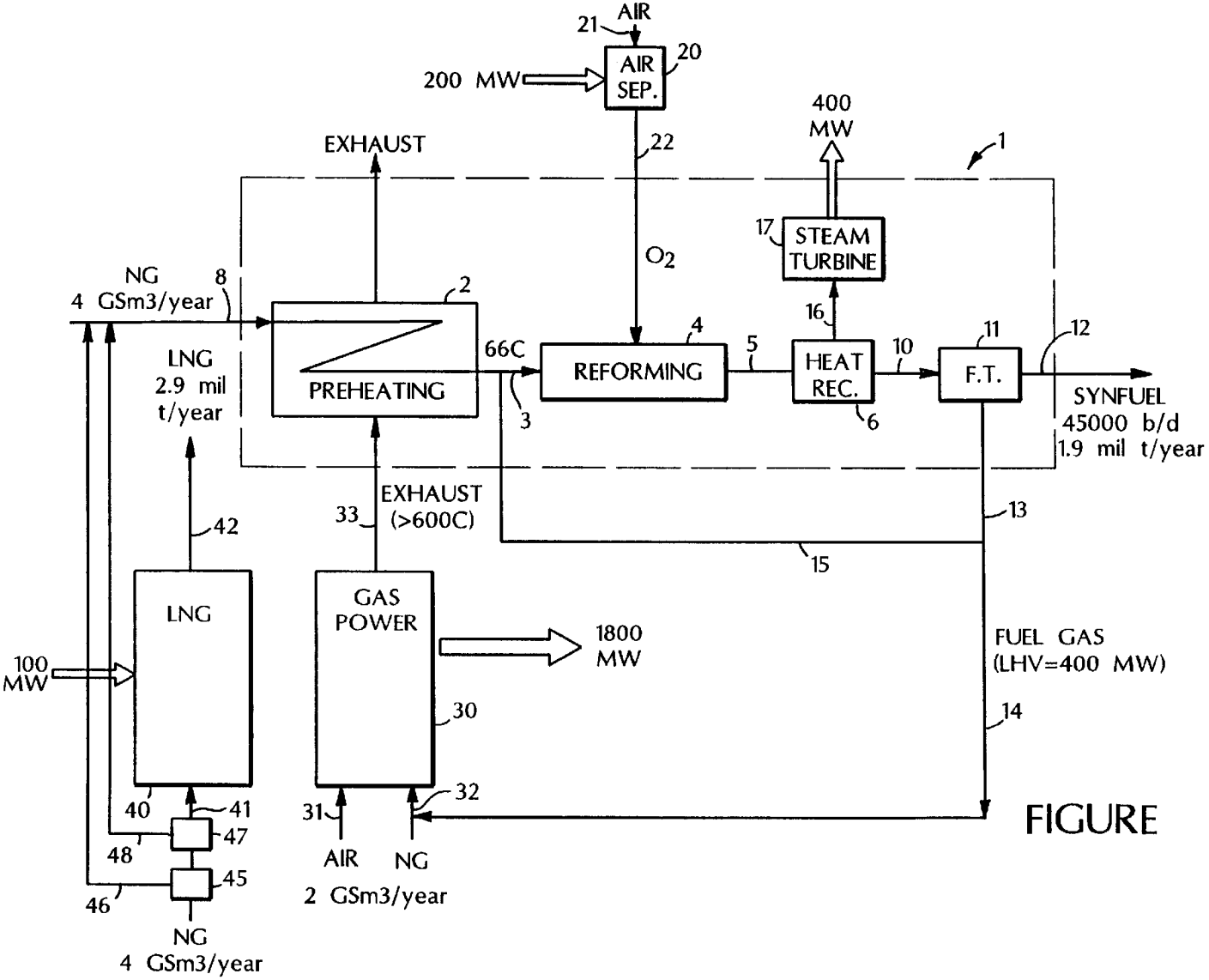
FIGURE

PROCESS AND AN INTEGRATED PLANT FOR THE PRODUCTION OF SYNFUEL AND ELECTRICAL POWER

This application is a 371 of PCT/No. 98/00023 filed on Jan. 23, 1998.

The present invention relates to a processing and converting a hydrocarbonous gas, particularly natural gas in an integrated plant for the preparation of useful products, including chemical reaction products and mechanical or electrical power, as well as an integrated process plant for the accomplishment of such a process.

By the term <<hydrocarbonous gas>> in the present context and the appending claims is understood hydrocarbon compositions consisting of hydrocarbon components substantially existing in a gaseous form at standard pressure and temperature conditions.

Natural gas is an important part of numerous petrochemical reservoirs and can find utilization as starting materials for further refined products in the form of pure hydrocarbons and in the form of oxidized derivatives thereof. Further, natural gas can be used for the production of power such as electrical power or mechanical power.

In many instances the natural gas reservoirs are situated at remote sites from the established natural gas markets where the utilization thereof, as mentioned above, takes place. This is e.g. the case in Europe, where the petrochemical sources are situated at the sea bottom far away from the European continent.

As a consequence thereof it will not be economical to transport the gas through pipelines to the users, the pipeline systems being long and expensive to install and later also to maintain.

For this reason the options of converting natural gas to other transportable and useful products will be considered, such as e.g. synfuel (synthetically prepared engine fuels in liquid form) and electrical power. Depending on whether the further handling of the gas takes place at an offshore production platform or at the site of entering the ground, it is—provided that the further useful products are to be prepared at one and the same geographical site—economical to evaluate the integration benefits which may be achieved by a suitable connection of the various kinds of plants for the abovementioned purposes.

Natural gas substantially consists of methane admixed with other gaseous hydrocarbons, $CO_2$ and gaseous sulphur compounds such as $H_2S$ and lower mercaptanes.

When the methane is preheated to a temperature of the order 800° C. and then is supplied with oxygen in a reforming step, oxygenated products of the methane are formed primarily in the form of CO and $H_2$. This gas composition is called <<synthesis gas>>. Such a synthesis gas may alternatively be prepared by reacting the hydrocarbonous material with aqueous vapour under pressure and at high temperatures according to the scheme:

$$CH_4+H_2O \rightarrow CO+3H_2.$$

When the synthesis gas is formed by partial oxidation, energy is released in the form of heat. This heat may be recovered from this step and optionally transferred to mechanical or electrical power.

The synthesis gas may then be reacted in a further step to methanol and dimethyl ether or in a Fischer-Tropsch synthesis to straight alkanes and/or alkenes of a higher molecular weight than the prevailing hydrocarbons of the natural gas.

$$nCO + (2n+1)H_2 \dashrightarrow C_nH_{2n+2} + nH_2O$$

$$nCO + 2nH_2 \xrightarrow[\text{cobolt catalyst}]{} C_nH_{2n} + H_2O$$

The products of the reaction step of carbon monoxide and hydrogen gas is the product called <<synfuel>>(synthetic fuel) and being the intended product of the process. The chemical composition of the product will depend on the preparation method and the operation conditions. The term synfuel thus covers products such as methanol, dimethyl ether, mixtures of methanol and dimethyl ether, other oxygenates, Fischer-Tropsch hydrocarbons and further processed products thereof, among others lubricants which may be prepared from the heavier Fischer-Tropsch hydrocarbonous fractions.

Furthermore, non-reacted gas and side products may be recovered as a separate stream and may be recycled to the reforming step or used as fuel for the production of power.

The conversion of synthesis gas is e.g. disclosed in G. A. Mills, <<Status and opportunities for conversion of synthesis gas to liquid fuels>>, Fuel, vol. 73(8) pp 1243–1279, (1994).

The Norwegian publication 179 169 discloses a process of converting natural gas to a normally liquid, carbonous compound such as methanol and/or dimethyl ether and/or liquid hydrocarbons of gasoline quality and/or olefins. The process avoids requirement of vapor reforming and/or adiabatic reforming of natural gas to synthesis gas using a substantially pure oxygen. The synthesis gas may be prepared at an operative pressure which is useful for converting the gas to methanol and/or dimethyl ether without recompression of the synthesis gas. The exhaust gas from the overhead has, subsequent to the conversion of the crude product methanol/DME and/or conversion to liquid hydrocarbons of gasoline quality, generally a BTU-capacity which is required for the use as fuel gas for the power supply being required for the operation of the required gas compression facilities used in the process. This renders the operation of the plant more economical and a process useful at remote sites. Particularly claim 4 of the publication for opposition states that air is introduced in the compressor unit of the gas turbine, the residual gas balance from the synfuel production including unreacted $H_2$, CO and methane, being introduced through the fuel entrance of the <<expander-driver>> unit of the gas turbine as a fuel for this part of the air from the outlet of compressed air from the gas turbine being lead to the entrance of a gas compressor driven by the gas turbine for compressing natural gas being introduced through the entrance to a gas compressor operated by a gas turbine and compressed to an enhanced end-pressure, the end-compressed air being heated to a higher temperature, the compressed natural gas being heated to a high temperature, the compressed gases being used in an adiabatic reaction yielding a reformed gas stream having a temperature of 982–1371° C.

U.S. Pat. No. 5,177,114 claims the same priority as the Norwegian publication No. 179169 and does not appear to differ be substantially therefrom.

U.S. Pat. No. 4,927,856 combines the production of electrical power, hydrogen gas production and methanol in an integrated system and discloses a corresponding process. The electricity is formed in turbines run by heated gas from a pressurized fuel source, and the electricity is then used in an electrolysis unit converting water, optionally condensed from the source gas, to hydrogen gas which is subsequently reacted with hydrocarbon oxides of the source gas under the formation of methanol.

U.S. Pat. No. 5,245,110 discloses the preparation of an oxygen enriched gas composition in an apparatus comprising a gas turbine, an oxidation separation plant in a fluid connection with the turbine air compressor and means for maintaining an appropriate mass balance-tolerance between the turbine compressor unit and the turbine power production unit.

In U.S. Pat. No. 5,284,878 methanol is produced by reacting a CO-rich synthesis gas in the presence of a powder methanol synthesis catalyst suspended in an inert aqueous phase reactor system. Unreacted CO-rich synthesis gas is recycled to the reactor. Preferably the process is integrated with a carbon gasification system for the production of electrical power in which one part of the unreacted synthesis gas is used as a fuel, and part of the methanol product is used as further fuel in periods of an increased demand.

U.S. Pat. No. 4,296,350 discloses the production of mechanical and electrical power combined with synthesis or fuel gas in a partial oxidation process by integration combustion and steam turbines. The side product evaporated prior to condensed natural gas is brought through pipelines to the gas consumers. The conversion of the synthesis gas to synfuel is not disclosed.

U.S. Pat. No. 4,359,871 discloses a process and an apparatus for the cooling of natural gas.

When gas recovered from petrochemical reservoirs at the sea bottom in arctic wafers is brought ashore to a land based plant, in arctic regions, problems arise and conditions which are substantially distinguished from the conditions under which the abovementioned prior art aims to solve the problems.

The distance to the site of use is long and transport of gas through pipelines to these will require immense investments and pipelines which will be uneconomical.

Further, the sites of bringing ashore may be far away from suitable energy sources which are required in the further processing of the natural gas brought ashore.

These conditions result in particular problems which are therefore not found to be solved through the prior art technique.

A maximum integration of such a plant is desirable which must simultaneously produce products which are well suited for the transport in a liquid form to a site of use.

This problem may be solved by a process as disclosed in the introduction wherein unreacted natural gas or other hydrocarbonous gas is fed to a plant for converting the starting material via a hydrogen or carbon monoxide containing gas, particularly a synthesis gas, to a stream of conversion products comprising a major part of the chemical reaction products, and an exhaust stream comprising a major part of unreacted amounts of carbon monoxide, hydrogen or synthesis gas, residual amounts of low molecular products, steam, carbondioxide and inert components, unreacted starting materials and optionally the exhaust stream from the gas conversion step are fused with an oxygen containing gas, preferably air, and then fed to a power plant for the production of mechanical or electrical power for the operation of the machinery of the integrated plant and for export, and for the formation of a warm exhaust, and that at least a part of the required amount of power for this purpose is fed to the plant from the power plant or conversion plant, and the exhaust from the gas power station is fed to the conversion plant as a heat exchange medium for the preheating step for heating a natural gas starting material for the preparation of the carbon monoxide containing gas.

A further preferred aspect of the process of the invention is the separation of air in an air separation plant for the preparation of an oxygen rich stream of gas which is reacted with the heated natural gas and optionally steam in the conversion plant for the preparation of a warm synthesis gas.

The required amount of energy for this aim is supplied to the air separation plant from the gas power plant or conversion plant.

A further preferred aspect of the process of the invention is the separation of carbon dioxide residing in the exhaust gas stream from the conversion plant from said gas stream and the stream of natural gas starting material is fed to the conversion plant.

A further preferred aspect is that the natural gas starting material being fed to the conversion plant is heated in a preheating unit/furnace to a temperature of at least 500° C. and reached with an oxygenous gas and optionally steam in a reforming reactor for the partial oxidation and reforming of the starting material to a warm gas composition including hydrogen, carbon monoxide, carbon dioxide, oxygen or nitrogen, whereupon the resulting warm gas composition is passed through a heat recovering unit, in which a tempered gas composition having a temperature being lower than 350° C. is obtained, and the tempered gas composition is reacted in one or more reactors to chemical reaction products and exhaust streams.

The last-mentioned reaction may be a reaction to e.g. the oxidized products methanol and dimethyl ether or may be a Fischer-Tropsch reaction resulting in alkanes or alkenes, or the reaction may also involve a further reaction to more oxygenated products, e.g. a carbonylation of methanol to acetic acid.

As a consequence thereof, a preferred embodiment may be the presence of a synthesis gas composition in the reforming plant as a starting material for the preparation of Fischer-Tropsch products.

As a consequence of the abovementioned, a plant designed for the carbonylation and hydrocarbonylation of a suitable starting material can be used.

A further aspect may be that part of the exhaust stream from the last step of the conversion plant is recycled through a conduit to a previous step of the process, e.g. that it is admixed with the preheated natural gas and entering the reforming reactor with this. A preferred aspect is further that carbon monoxide is recovered from the carbon monoxide containing gas being produced in the conversion plant and is used for the carbonylation of a suitable starting material.

It is further preferred that heat power being released by cooling of the warn gas composition being passed through the heat recovery unit is converted to further amounts of mechanical or electrical power.

Further it is preferred that compressed air for the preparation of an oxygen rich gas composition being used for the oxidation of the natural gas starting material of the conversion plant is taken from the outlet to an air compressor which is connected to a gas turbine of the power plant.

Further, it is preferred that NGL-components (liquid components of the natural gas) are reduced in amount or removed from the natural gas, and the thus obtained NGL depleted natural gas is used as a starting material for the conversion to a carbon monoxide containing gas in the conversion plant, which conversion is performed by <<gas heated reforming>>.

Further, the present invention relates to an integrated plant for processing and converting natural gas or other hydrocarbonous gas for the preparation of useful products including chemical reaction products and mechanical or electrical power, which integrated plant comprising:

a plant for converting the starting material via a carbon monoxide containing gas, particularly a synthesis gas, to a stream of conversion products comprising a major part of the chemical conversion products and an exhaust stream, comprising a major part of unreacted amounts of carbon monoxide, hydrogen or synthesis gas, residual amounts of low molecular products, steam, carbon dioxide and inert components, a power plant for the production of mechanical or electrical power by reacting unreacted residues of the starting material and optionally the exhaust gas stream from the gas conversion step with an oxygen containing gas, preferably air, for the operation of machinery of the integrated plant and for export, and for the production of a warm exhaust being used as heat exchange medium for heating the starting material for the production of the carbon monoxide containing gas of the conversion plant.

In this integrated plant a connection is made between the gas power plant and the preheating means for the transport of exhaust gas from the first mentioned to the last mentioned, as well as heat exchange tubes in the last mentioned for an efficient transfer of heat from the exhaust gas to the natural gas which is to be preheated.

Further, it is preferred that the plant comprises an air separation plant for the preparation of an oxygen enriched gas stream for the feed to the reforming reactor for reforming the preheated natural gas from the preheating means.

It is preferred that the preheating means is designed for heating the natural gas to at least 500° C., that the reforming reactor is designed for partial oxidation and reforming of the natural gas to a warm gas composition including hydrogen, carbon monoxide, carbon dioxide, oxygen or nitrogen, and the heat recovering unit is designed to provide for a tempered gas composition having a temperature below 350° C.

A further preferred embodiment of the conversion plant comprises a plant for carbonylization or hydro carbonylization of natural gas.

In the following the invention is described with reference to the appending figure showing an integrated plant for the production of synfuel and gas power.

On the figure the fed amounts of natural gas and produced amounts of product and energy on a yearly basis is indicated.

MW=megawatt t=ton.

BRIEF DESCRIPTION OF THE DRAWINGS

A natural gas stream 8, which may include a supplement being passed through a conduit 46 from a plant for the partial liquefaction of natural gas, is passed to a prewarming unit 2 having a heat supply by exhaust gas at a temperature above 600° C. through a pipe 33 from a gas power plant 30 situated close by. The exhaust gas is passed in a unit 2 through a heat exchange plant for efficient transfer of heat to the natural gas to be heated. When required, a plant for further direct heating of the prewarming unit may be provided. The exhaust gas is vented to the atmosphere after the delivery of heat to the prewarming unit.

The prewarmed natural gas at a temperature of at least 600° C. is then passed through conduits 3 to a reforming reactor 4.

This reforming reactor is simultaneously fed oxygen enriched gas from an air separator 20 which is again fed atmospheric air from the surroundings to an inlet 21, the feed of the oxygen enriched gas is indicated by 22. The reforming in the reforming reactor 4 is run under conditions which are closer defined in:

I. Dybkjaer, <<Tubular reforming and autothermal reforming of natural gas—an overview of available processes>>, Fuel Processing Technology Vol. 42, pp 85–107 (1995).

B. M. Tindall and M. A. Crews, <<Alternative technologies to steam-methane reforming>>, (Hydrocarbon processing, 75, Nov 1995).

Å, Solbakken, <<Synthesis gas production>>, (Natural Gas Conversion pp 447–455, A. Holmen et al. (ed), Elsevier Publ. 1991).

The synthesis gas including molecular hydrogen and carbon monoxide as the further desired reactants, but in admixture with oxygen, carbondioxide, nitrogen and other unreacted natural gas components, is passed through the pipe 5 to a heat recovery plant 6. About 400 MW may be recovered therefrom on a yearly basis. This heat can be used for the production of power as e.g. indicated by a steam turbine 17.

The cooled synthesis gas is then passed through a pipe 10 to a Fischer-Tropsch synthesis plant 11. The Fischer-Tropsch reaction of the Fischer-Tropsch synthesis plant will include a catalyst, e.g. a cobalt catalyst which, in addition to cobalt, may include parts of rhenium and thorium oxide as disclosed in European patent application 0220343 A-1 and Norwegian patent No. 178 958. The catalyst may exist in a fixed layer as well as in a suspended form in the process.

Typical operation conditions for Fischer-Tropsch conversion are:

1. Total pressure of 5–80 bar, preferably 10–50 bar, particularly 20–40 bar,

2. Space velocity (the inverse of residence time): 100–20,000 vol. (SPT)/vol.(cat)* hours, preferably 300–10,000, particularly 500–5000.

3. Temperature 160–300° C., preferably 180–200° C., particularly 200–240° C.

4. Ratio $H_2$/CO (inlet) 1.0–3.0, preferably 1.5–2.5, particularly 1.7–2.1.

The produced synfuel is recovered as the product from the Fischer-Tropsch reaction through the outlet 12. This synfuel will be subject to a further refining process depending on the intended use, but this refining is not considered part of the present invention and is not disclosed herein.

Fuel gas is recovered from the Fischer-Tropsch synthesis through the outlet 13. Part of this gas stream may be recycled to a conduit 15 to the process, mixed with the preheated gas and together with this, passed to the reforming reactor.

The residual part is passed through a pipe 14 and mixed with natural gas fed through a conduit 32 to a gas power plant 30 which is simultaneously supplied with fuel air through a pipe 31. On an annual basis the gas power plant produces, by combustion of the mixture of natural gas and fuel gas from the Fischer-Tropsch reactor, about 1800 MW, at the same time supplying exhaust gas as previously mentioned for the preheating of the natural gas to the reforming.

In the present embodiment the integrated plant further comprises a plant 40 comprising equipment for the preparation of liquefied natural gas (=LNG) by compression and cooling of 4 giga standard $m^3$ per year of natural gas. Prior to condensing the natural gas to LNG, it is required to remove $CO_2$ from the gas to be condensed. This is performed in a $CO_2$ elimination plant 45.

If the natural gas includes heavier components (NGL components such as methane, propane, butane etc.), it may also be required, depending on the amount and identity of such components, to separate such components from the starting material being fed to the LNG plant 40. Such separation of heavier components is performed in a NGL separation plant 47.

The separated $CO_2$ and heavier components which are separated in the NGL separation plant 47, are passed through conduit 46 and 48 respectively together with the fed 8 to the preheating step 2 prior to the reformation.

A cryogenic process for the separation of air or preparation of nitrogen (and which concomitantly will result in an oxygen enriched stream of air) which can be used in the present air separation plant, is e.g. described in the Norwegian publication for opposition No. 177728.

A process for the preparation of intermediate distillates in Fischer-Tropsch synthesis with cobalt catalysts including parts of zirconium, titanium and chromium, followed by a hydrogenation conversion of the total synthesized products on a born noble-metal catalyst is disclosed in the European patent application 0147873 A-1, and the conditions for the preparation of methanol from synthesis gas, is e.g. disclosed in the European patent application 0317035 A-2.

Particular benefits achieved by a plant according to the present invention of the kind disclosed herein, is that an integrated plant for the production of synfuel is obtained which, in addition to produce gas power in considerably economical amount, also results in exhaust gas which may be used for preheating the plant, the exhaust gas from the synfuel production constituting part of the fuel for the gas power plant to obtain a maximum utilization of products and side-products from this plant.

Such an integrated operation and such an integrated plant are, according to the applicant's knowledge, not previously described and constitute a valuable contribution to the field natural gas technology.

The inventive spirit is formulated in the appending claims. These are, however, not meant to limit the invention, all equivalents residing within the defined scope also having to be considered to constitute part of the inventive spirit.

What is claimed is:

1. A process for processing and converting a hydrocarbonous gas in an integrated plant for the preparation of chemical reaction products and mechanical and electrical power, wherein a starting material comprising a first part of the hydrocarbonous gas is fed to a plant for converting the starting material via carbon monoxide-containing gas to a stream of converted products comprising a major part of the chemical reaction products, and an exhaust gas stream comprising a major part of unreacted amounts of carbon monoxide, hydrogen or synthesis gas, residual amounts of low molecular products, steam, carbon dioxide and inert components, a second part of the hydrocarbonous gas and an oxygen-containing gas is fed to a power station including at least one gas turbine for the production of mechanical or electrical power for the operation of machinery in the integrated plant and for export, and for the manufacture of a warm exhaust gas, and wherein the exhaust gas from the at least one gas turbine of the gas power station is supplied as a heat exchange medium at a temperature of at least about 500° C. to a prewarming step for heating the starting material for the preparation of the carbon monoxide-containing gas of the conversion plant.

2. The process of claim 1, wherein at least a part of the exhaust gas stream from the conversion plant is supplied to the power station for production of further amounts of power and warm exhaust gas.

3. The process of claim 1 or 2, wherein a third part of the hydrocarbonous gas is fed to a gas processing plant wherein the hydrocarbonous gas, by compression, cooling or rectification, is converted to single components of the starting material, and wherein the required energy for this purpose is supplied to the plant from the power station or a heat power station connected to the conversion plant.

4. The process of claim 1, wherein carbondioxide in the hydrocarbonous gas as fed to the gas processing plant is separated from the gas and used as a part of the starting material for the preparation of conversion products in the conversion plant.

5. The process of claim 1, wherein substantial amounts of components present in the hydrocarbonous gas being fed to the gas processing plant and which has a molecular weight which is higher than the molecular weight of methane, is separated from the gas and used as part of starting material for the preparation of conversion products in the conversion plant.

6. The process of claim 1, wherein air is separated in an air separation plant for the preparation of an oxygen rich gas stream which is reacted with the heated starting material in the conversion plant for the preparation of synthesis gas, and wherein the required amount of power for this purpose is supplied to the plant from the power plant or a heat power station, connected to the conversion plant.

7. The process of claim 1, wherein carbondioxide, which is present in the exhaust gas stream from the converison plant, is separated from said gas stream and supplied to the stream of starting material in the conversion plant.

8. The process of claims 1, wherein the starting material which is fed to the conversion plant is heated in a prewarming unit/furnace at a temperature of at least 500° C. and reacted with an oxygen containing gas in a unit for the partial oxidation and reforming of the starting material to a warm gas composition including hydrogen, carbon monoxide, carbon dioxide, oxygen or nitrogen, whereupon the resulting warm gas composition is passed through a heat recovering unit, whereby a tempered gas composition having a temperature being lower than 350° C., is obtained, the tempered gas composition is reacted in one or more reactors to chemical reaction products and exhaust gas streams.

9. The process of claims 1, wherein the conversion plant manufactures a synthesis gas composition being used as a starting material for the preparation of Fischer-Tropsch products.

10. The process of claims 1, wherein a plant which is designed for carbonylation or hydrocarbonylation of a starting material, is used as conversion plant.

11. The process of claim 1, wherein a plant which is designed for the manufacture of methanol or dimethyl ether, or compositions of methanol or dimethyl ether, is used as the conversion plant.

12. The process of claims 1, wherein a part of the gas stream from the conversion plant is recycled (via a conduit) to a previous step in the process.

13. The process of claim 2, wherein carbon dioxide, which is either recovered from the hydrocarbonous starting material which is fed to the processing unit, or carbon dioxide being a part of the exhaust gas stream from the conversion plant is recycled to the inlet stream of the conversion plant.

14. The process of claim 2, wherein carbon monoxide recovered from the carbon monoxide containing gas which is manufactured in the conversion plant, and used for carbonylation of a starting material.

15. The process of claim 1, wherein heat power being released during cooling of the warm gas composition, which is passed through the heat recovery unit, is converted to further amounts of mechanical or electrical power.

16. The process of claim 2, wherein compressed air for the preparation of an oxygen rich gas composition to be used for oxidation of the carbonous starting material in the conversion plant is withdrawn from an outlet of an air compressor connected to a gas turbine of the power plant.

17. The process of claim 2, wherein the contents of NGL components are reduced or eliminated from the first part of the hydrocarbonous gas, and the thus obtained NGL depleted gas is used as a starting material for the conversion to a carbon monoxide containing gas in the conversion plant, the conversion of the NGL poor gas being effected by gas heated reforming.

18. An integrated plant for processing and converting a hydrocarbonous gas in an integrated plant for the preparation of chemical reaction products and mechanical or electrical power, wherein the integrated plant comprises a plant for conversion of the starting material via carbon monoxide-containing gas through a stream of conversion products, comprising a major part of the chemical conversion products, and an exhaust gas stream comprising a major part of the unreacted amounts of carbon monoxide, hydrogen or synthesis gas, residual amounts or low molecular products, steam, carbon dioxide and inert components, a power plant including at least one gas turbine for the production of mechanical or electrical power by reacting the starting material with an oxygen-containing gas for the preparation machinery in the integrated plant and for export, and for the manufacture of a warm exhaust, which is used at a temperature of at least about 500° C. as heat exchange medium for the heating of the starting material for preparing the carbon monoxide-containing gas in the conversion plant, having a connection between the gas power plant including at least one gas turbine and the preheating means, for transport of exhaust gas from the first mentioned to the last mentioned, as well as heat exchange tubes in the last mentioned, for converting heat from the exhaust gas to the hydrocarbonous gas being preheated.

19. The plant of claim 18, characterized in an air separation plant for the preparation of an oxygen-enriched gas stream as feed to the reforming means for reforming the preheated natural gas from the preheating means for converting heat from the exhaust gas to the natural gas being preheated.

20. The plant of claim 18 or 19, wherein the preheating means is designed for heating natural gas to at least 500° C., the reforming means being designed for partial oxidation and reforming of natural gas to a warm gas composition including hydrogen, carbon monoxide, carbon dioxide, oxygen or nitrogen, and the heat recovery unit is designed to provide a tempered gas composition having a temperature below 350° C.

21. The plant of claim 18, wherein the conversion plant is a plant for carbonylation or hydrocarbonylation of natural gas.

22. The plant of claim 18, further comprising a gas processing plant for the preparation of liquid single components, having a supplement of required energy for this purpose from the power plant or a heat power station connected to the conversion plant.

23. The process of claim 1, wherein the hydrocarbonous gas comprises natural gas.

24. The process of claim 1, wherein the carbon monoxide-containing gas comprises synthesis gas.

25. The process of claim 1, wherein the oxygen-containing gas comprises air.

26. The process of claim 3, wherein the single components of the starting material are in liquid form.

27. The process of claim 26, wherein the single components of the starting material in liquid form comprise LNG.

28. The process of claim 6, wherein the oxygen rich gas stream is reacted with the heated starting material and steam.

29. The process of claim 8, wherein the starting material is reacted with the oxygen-containing gas and stream.

30. The plant of claim 18, wherein the hydrocarbonous gas comprises natural gas.

31. The plant of claim 18, wherein the carbon monoxide-containing gas comprises synthesis gas.

32. The plant of claim 18, wherein the power plant for production of mechanical or electrical power reacts the starting material and the exhaust gas stream from the gas conversion step with an oxygen-containing gas.

33. The plant of claim 18, wherein the oxygen-containing gas comprises air.

34. The plant of claim 22, wherein the liquid single components comprise LNG.

* * * * *